United States Patent [19]

Bögel

[11] Patent Number: 5,066,181

[45] Date of Patent: Nov. 19, 1991

[54] ATTACHMENT ELEMENT WITH LARGE WASHER

[75] Inventor: Gerhard Bögel, Balgach, Switzerland

[73] Assignee: Stadler AG, Heerbrugg, Switzerland

[21] Appl. No.: 274,058

[22] PCT Filed: Jan. 13, 1988

[86] PCT No.: PCT/EP88/00020

§ 371 Date: Sep. 21, 1988

§ 102(e) Date: Sep. 21, 1988

[87] PCT Pub. No.: WO88/05487

PCT Pub. Date: Jul. 28, 1988

[30] Foreign Application Priority Data

Jan. 21, 1987 [AT] Austria ..... 104/87

[51] Int. Cl.[5] ..... F16B 35/02

[52] U.S. Cl. ..... 411/383; 411/387; 411/533; 52/512

[58] Field of Search ..... 411/383, 384, 368, 369, 411/533, 923, 387; 52/410, 512

[56] References Cited

U.S. PATENT DOCUMENTS

| | | | |
|---|---|---|---|
| 2,334,406 | 11/1943 | Gray | 108/33 |
| 4,074,501 | 2/1978 | Sandqvist | 52/741 |
| 4,361,997 | 12/1982 | DeCaro | 411/533 |
| 4,642,012 | 2/1987 | Blucher et al. | 411/371 |
| 4,726,164 | 2/1988 | Reinwall et al. | 411/533 |
| 4,757,661 | 7/1988 | Hasan | 52/512 |
| 4,862,664 | 9/1989 | Romine | 52/410 |

FOREIGN PATENT DOCUMENTS

| | | | |
|---|---|---|---|
| 380051 | 4/1986 | Austria . | |
| 0161337 | 11/1985 | European Pat. Off. . | |
| 2617911 | 9/1977 | Fed. Rep. of Germany . | |
| 3045986 | 6/1982 | Fed. Rep. of Germany . | |
| 3344048 | 6/1984 | Fed. Rep. of Germany . | |
| 3515734 | 11/1986 | Fed. Rep. of Germany | 411/383 |
| 3539752 | 5/1987 | Fed. Rep. of Germany . | |
| 2476771 | 8/1981 | France . | |
| 7601657 | 8/1977 | Netherlands . | |
| 1449224 | 1/1978 | United Kingdom . | |

*Primary Examiner*—Neill R. Wilson
*Attorney, Agent, or Firm*—Horst M. Kasper

[57] ABSTRACT

In the case of an attachment element (1), a large washer (5), and a tubular extension (6) formed thereon, are provided for the passage and guidance of a screw (4). The washer (5) and the tubular extension (6) are in the form of parts made separately from each other. The tubular extension (6) carries, at the end facing the washer (5), a shoulder (7) engaging in a corresponding depression in the vicinity of an opening in the washer (5). The section (8), adjoining the shoulder (7), of the tubular extension (6), can be introduced through the opening in the washer (5). The screw (4) is inserted into the extension (6) before or after the said extension has been inserted into the said washer.

38 Claims, 9 Drawing Sheets

Fig. 21
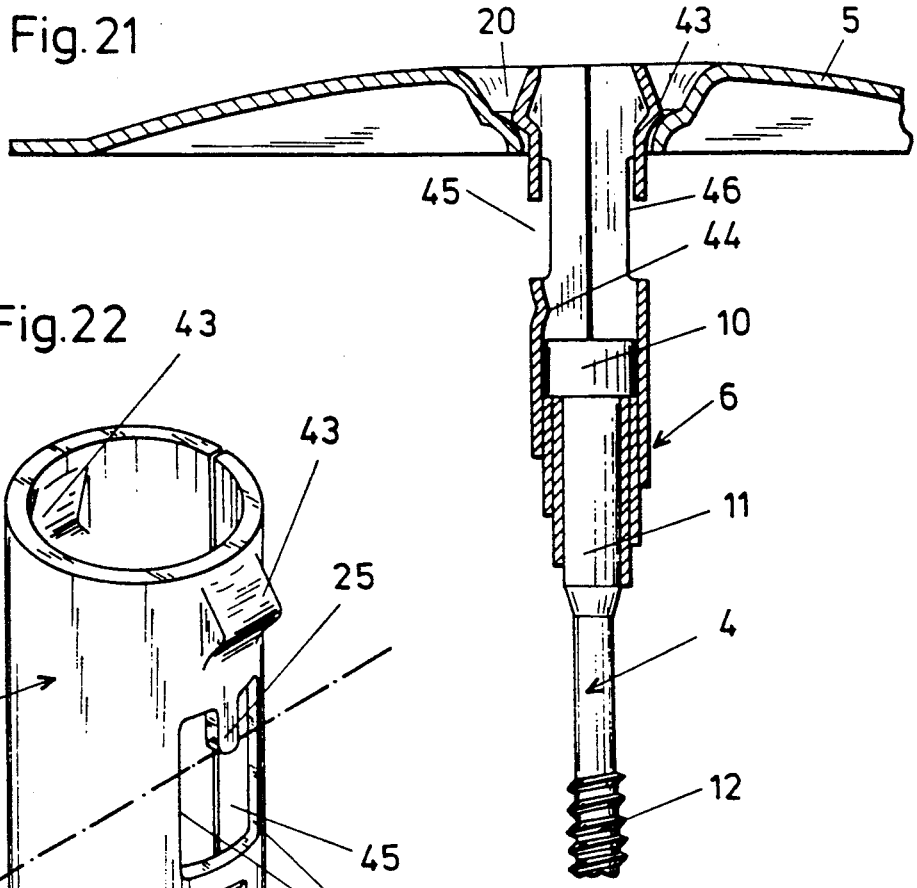
Fig. 22
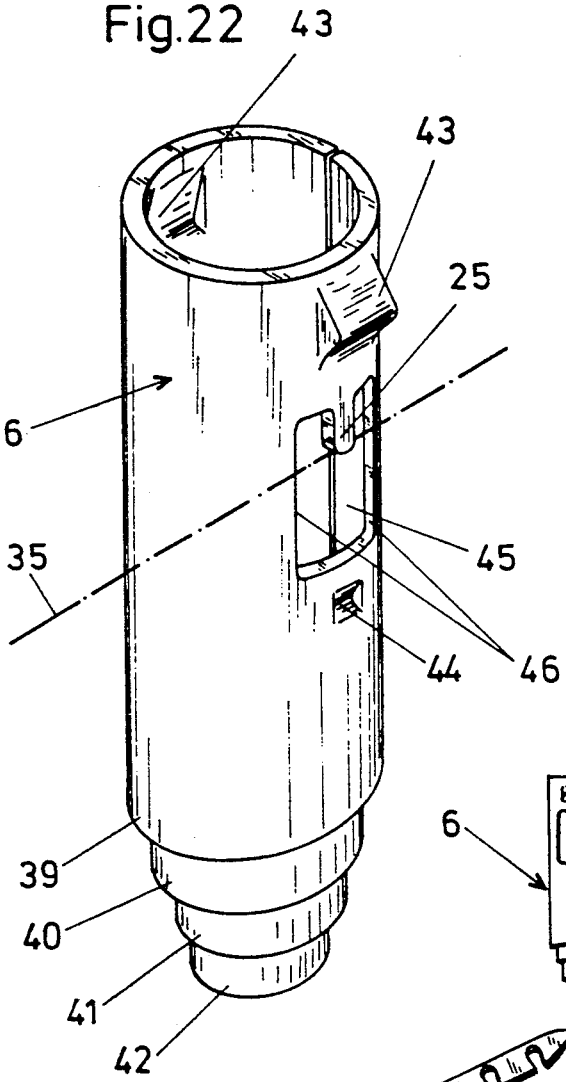
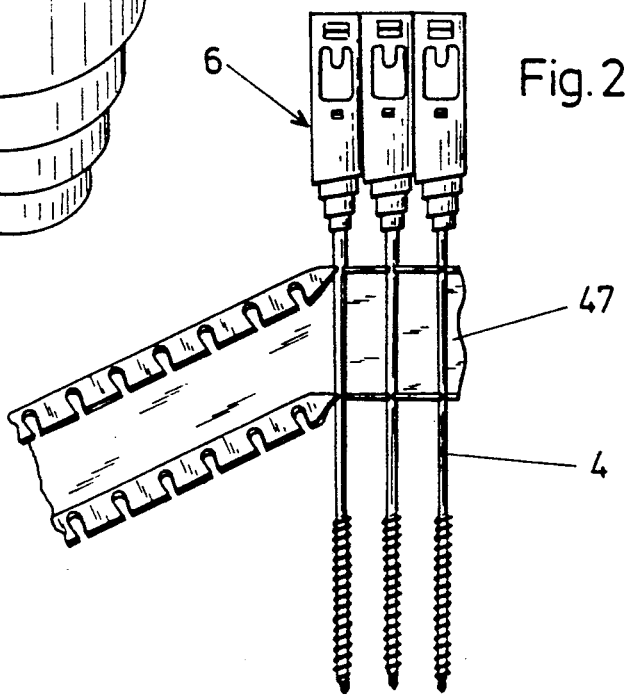
Fig. 23

ATTACHMENT ELEMENT WITH LARGE WASHER

CROSS-REFERENCE TO RELATED APPLICATIONS

This application is a continuation-in-part application of another international application filed Jan. 13, 1988 under the Patent Cooperation Treaty and bearing application No. PCT/EP88/00020. The entire disclosure of this application, including the drawings thereof, is hereby incorporated in this application as if fully set forth herein.

The invention relates to an attachment element comprising a large washer having a built-on tubular extension for the passage and guidance of a screw.

Attachment elements of this kind are normally used to secure insulating materials to a fixed base, e.g. for attaching insulating panels to roofs. If materials have to be transported on a roof, a workman may happen to step upon a washer or near it, or a vehicle or tools may travel over the washer. Local forces of this kind cause the head of the screw to pass through the applied sealing material or the washer to pierce the roofing material applied to the insulating material.

It has already been proposed to provide a stop at a distance from the head of the screw in the thread-free shaft-section, so that the area of the washer defining the opening can rest upon this stop and be adapted to tilt in relation to the axis of the bolt. Although this design was very successful, it must be regarded as a disadvantage that the screws must be relatively long, depending upon the thickness of the insulating material, since they must extend from the washer to the fixed base.

Attachment elements of the type mentioned at the beginning hereof are disclosed, for example, in DE-A-35,39.752 (subsequently published) and in AI-8-380.051; also in GB-A-1.499.224. In the case of another known design, a tubular extension is provided for the relatively large washer, into which the screw is inserted. The head of the screw lies within this tubular extension and is relatively deeply embedded in relation to the upper surface of the washer and this shortens the necessary length of the screw. The thickness of the insulating material to be secured may therefore be bridged by co-operation between the length of the tubular extension and the length of the screw. One disadvantage of this design, however, is that such washers, with their tubular extensions, are awkward to store and are too bulky for transportation and packaging. With a design of this kind, therefore, only a single setting-operation is possible, a screw being inserted into the washer, with its extension, whereupon individual screwing may take place at the relevant location. With this variant, prestorage of the washers and screws in a magazine is unthinkable.

It is therefore the purpose of the present invention to provide an attachment element of the type mentioned at the beginning hereof which is very simple to produce, can be packaged and transported in the best possible manner, and can be used in an economically optimal manner.

According to the invention, it is proposed, to this end, that the washer and the tubular extension be designed as separately produced parts, that the tubular extension comprise, at the end thereof facing the washer, a shoulder, projecting lugs, pins, nobs or the like; that the section of this tubular extension adjoining this end correspond approximately to the diametrical cross-section of an opening in the washer; that the free internal diameter of the extension correspond approximately, over the greatest length thereof, to the outside diameter of the head of the screw to be used; and that the free end of the extension be constricted to produce a friction-hold between the extension and the shank or the outside diameter of the thread of the inserted screw, so that the said tubular extensions, with inserted screws, can be prestored in a magazine.

These measures according to the invention make it possible, on the one hand to manufacture the washer and tubular extension out of any desirable materials, so that the properties thereof may be used optimally according to the application. It is also possible for the matched lengths of the screw and tbe tubular extension to bridge the thickness of the insulating materials to be attached. A tubular extension of this kind can thus be made to any desired length, thus optimizing the cost of bridging the overall distance. For instance, a very short screw may co-operate with a relatively long tubular extension.

Separate production of the washer and the tubular extension produces a kind of hinge between the washer and the part which is screwed, thus assuring a particularly safe foothold. In the case of a design of this kind, the washer may therefore tilt in relation to the tubular extension, so that a one-sided load can be absorbed without any difficulty.

The measures according to the invention not only provide an optimal hold between the tubular extension and the inserted screw, but also a mutual centering effect, thus assuring accurate setting while the screw is screwed in. Frictional retention of the screw within the extension also makes it possible to prestore the unit consisting of the extension and the screw, without either of them becoming lost. In spite of this, however, it is still possible to ensure that if the attachment element is stepped upon, the screw telescopes into the interior of the tubular extension.

A very significant advantage, also achieved by the measures according to the invention lies in the optimal possibility of storing in a magazine the individual parts of the attachment element. The relatively flat washers, and the tubular extensions with the inserted screws, may easily be packaged and prestored individually, the storing of individual screws already inserted into the tubular extensions being a simple matter. All that was needed, therefore, was to feed laterally to the setting tool the appropriately stored washers, so that setting of the screws is highly economical even when attachment elements according to the invention are used.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention:

FIG. 21 is a cross-sectional view through another embodiment of an attachment element;

FIG. 22 is a perspective view of an inserted tubular extension;

FIG. 23 illustrates a method of storing screws with fitted tubular extensions in a magazine strip;

DESCRIPTION OF INVENTION AND PREFERRED EMBODIMENT

Figure 1:
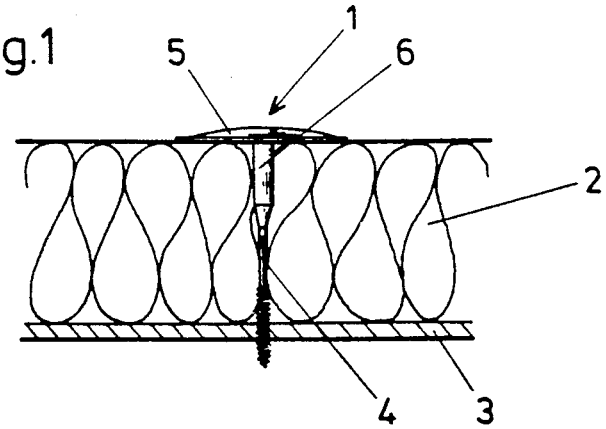
FIG. 1 illustrates a practical application of an attachment element securing insulating material to a fixed base.
Figure 2:
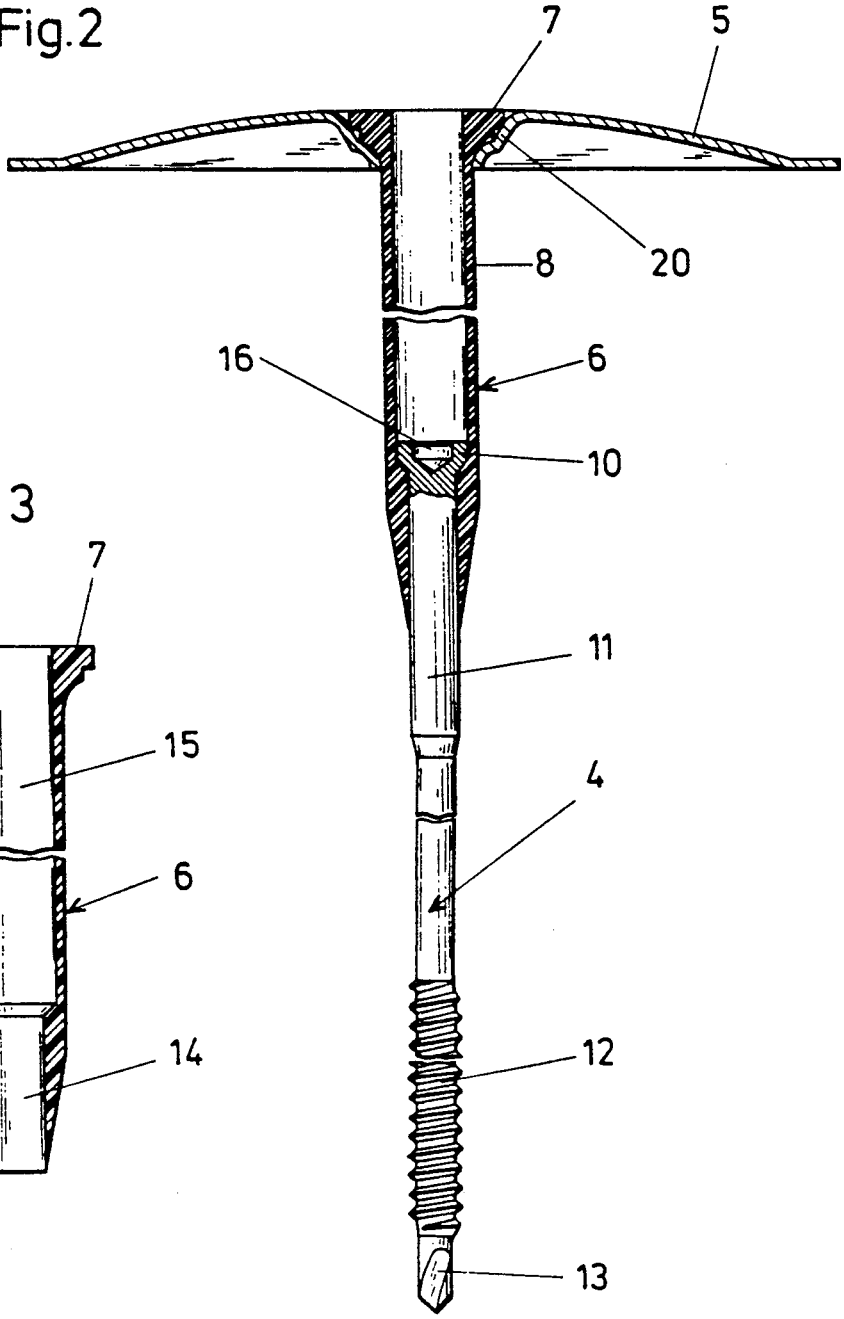
FIG. 2 is a partial cross-sectional view of an attachment element.
Figure 3:
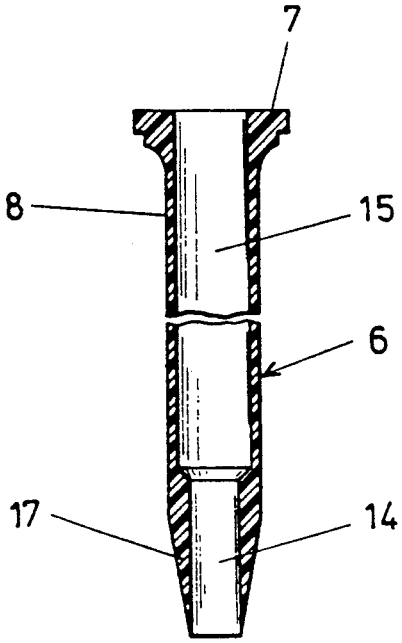
FIG. 3 is a longitudinal sectional view of a tubular extension according to FIG. 1.

It may be seen from FIG. 1 that an attachment element 1 is securing insulating material 2 to a fixed base 3, for example a metal section. In this case, the attachment element consists of a screw 4 and a relatively large washer 5 carrying a tubular extension 6.

A first example of embodiment of such an attachment element will now be explained in greater detail in conjunction with FIGS. 2 to 7. Washer 5 and tubular extension 6 are designed as separately produced parts, the said extension comprising a shoulder 7 at the end adjacent to the washer 5. As in the case of other examples of embodiments, which will be explained in greater detail hereinafter, it is possible to use projecting lugs, pins, nobs or the like in place of, or in addition to, shoulder 7. Section 8 of tubular extension 6, adjacent shoulder 7, is adapted approximately to the inside diameter of an opening in washer 5.

Screw 4 comprises a head 10, a thread-free shank-section 11, a threaded section 12 and a self-drilling tip 13. The diameter of shank-section 11 corresponds approximately to the outside diameter of threaded section 12 and diameter 14 at the other free end of tubular extension 6 also matches this diameter. The diameter of head 10 of the screw also corresponds approximately to the inside diameter of cylindrical section 15 of tubular extension 6. This not only provides an optimal hold between tubular extension 6 and inserted screw 4, but also a mutual centering effect, thus assuring accurate setting during the screwing-in process. With such an arrangement of a screw 4, an internal drive 16 is a simple matter.

Since tubular extension 6 and washer 5 are produced separately, it is possible to make washer 5 of metal and tubular extension 6 of plastic. It is very simple to make the tubular extension between the screw and the washer out of plastic. Measures may also be provided for simple prestoring of the tubular extension 6 and screw 4, and a screw 4 having an internal drive 16 provides satisfactory guidance for the attachment element during manual setting. This also permits feeding with a mobile prestorage unit and, finally, the attachment element may also be fitted to a magazine-strip for an automatic screwing unit. If the washers are made of a metal there is no problem in feeding them to automatic units.

In order to be able to accommodate shoulder 7 of the tubular extension, which actually transfers the force, in washer 5, the latter is arched convexly. This not only provides desirable stiffening of the washer, with no need for ribs of any kind, but has a very positive effect during the use of solvent-welding means for welding together the strips of roofing material. The concave arching of the washers may be such that it falls away towards the edge, ensures satisfactory pressure-distribution, and has no detrimental effect upon the welding of the roofing material.

If a welding operation is to follow, it may be desirable to make both washer 5 and tubular extension 6 out of plastic.

Another variant involves separating the individual parts, whereby washer 5 and/or tubular extension 6 and/or screw 4 may be made of a stainless material. This is an important factor in the case of attachments which are exposed to weathering or any kind of moisture. The screw in this case may be made in whole or in part of a stainless austenitic steel. It is also conceivable to make a screw out of two or more sections of different materials or different material-structures and/or differently hardened, the various sections being assembled by welding, gluing or the like. A solution of this kind would also be possible for tubular extension 6 in the case of an attachment element provided for special applications. Thus tubular extension 6 could also be made out of two or more sections of different materials, different material-structures and/or differently hardened, and assembled by welding, gluing or the like. End 17 of tubular extension 6 which, when the element is in use, is at a distance from washer 5, has an external conical taper. This penetrates very easily into the insulating material during the screwing-in process. The tubular extension thus encounters practically no resistance.

As already indicated, the washers illustrated in FIGS. 2 and 4 to 6 are arched. In this case the said washer exhibits a central, conical or multi-stepped opening 9. Peripheral edge 18 of the washer, and edge 19 of opening 9, lie approximately in one plane.

In order to obtain an adequate hold between tubular extension 6 and washer 5, the cross-sectional shape of shoulder 7 in extension 6 matches approximately the cross-sectional shape of depression 20 in washer 5.

Figure 8:
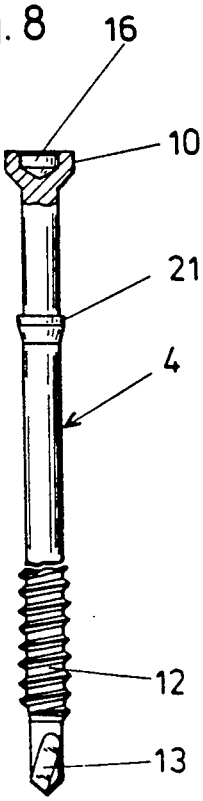
FIG. 8 is a perspective view of another embodiment of a screw to be inserted.

FIG. 8 shows another example of a screw 4 to be inserted. At a distance from head 10, the said screw comprises a shoulder 21 upon which the lower free end of tubular extension 6 can rest. This provides additional safety against undue descent of the unit consisting of extension 6 and washer 5, under load.

Figure 9:
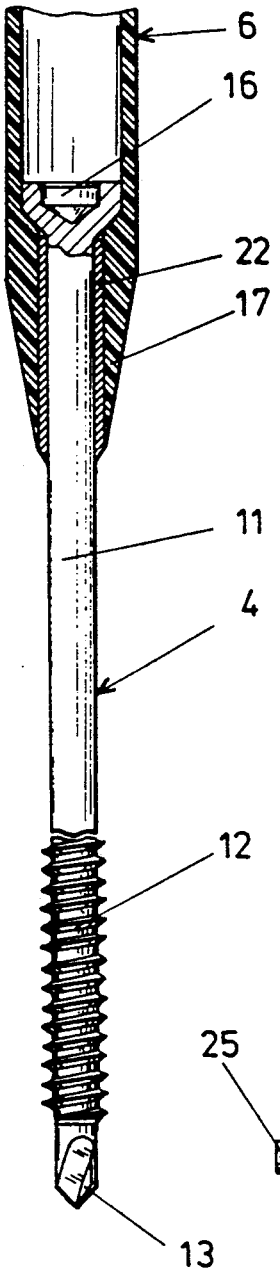
FIG. 9 is a cross-sectional view through part of the tubular extension with an inserted screw.
Figure 10:
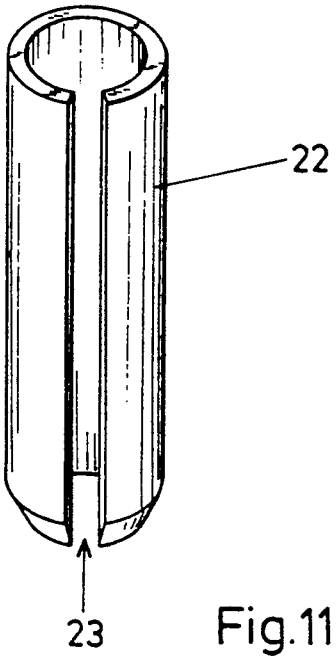
FIG. 10 is a perspective view of a sleeve inserted according to FIG. 1 and surrounding the shank of the screw.

FIGS. 9 and 10 illustrate another example of attachment element. In the screw used in this case, the outside diameter of threaded section 12 is larger than the outside diameter of shank-section 11. The diameter of the free passage in end-area 17 of extension 6 corresponds approximately to the outside diameter of threaded section 12 of screw 4. Thus in order to achieve, in spite of this, adequate guidance and retention of shank 11 of the screw in the extension, a sleeve 22 may be placed upon said shank 11, the outside diameter thereof again corresponding to the outside diameter of threaded section 12. It can therefore be fitted accurately into free end 17 of tubular extension 6. In order that sleeve 22 may easily be placed upon shank 11 of screw 4, the said sleeve comprises a longitudinal slot 23 so that it can be fitted laterally.

Figure 11:
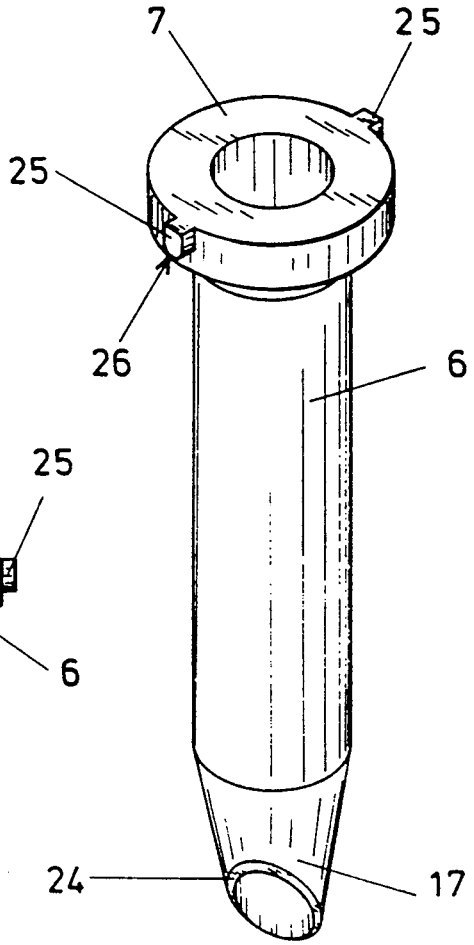
FIG. 11 is a perspective view of a tubular extension having specially designed ends.

In the design according to FIG. 11, it will be seen that the free end of extension 6 may be cut off at an acute angle to its longitudinal axis, thus forming a kind of drilling bit. This facilitates penetration into the underlying insulating material not only under axial pressure but also if extension 6 is rotated with screw 4. It may be seen from this FIG. 11 that the end of extension 6 adjacent washer 5 comprises a pair of projecting lugs 25 on opposite sides of the extension. These lugs provide an outstanding possibility for the storage and orderly feeding of extensions, and of extensions already prefitted with screws, to a setting tool. In the design according to FIG. 11, lugs 25 extend radially from shoulder 7 formed on the free end of extension 6. In other examples of embodiment, e.g. in FIGS. 13 and 14, lugs 25 are directed, adjoining shoulder 7, towards the other free end 17 of extension 6. In order to ensure satisfactory guidance of extension 6 in a corresponding storage channel, and to reduce friction, projecting lugs 25 are rounded off at surface 26 towards free end 17 of extension 6.

Figure 12:
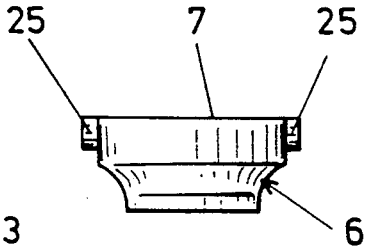
FIG. 12 is a view of an embodiment of a tubular extension.

As may be gathered from FIG. 12, tubular extension 6 may be made of any desired length, even with a relatively short axial dimensions. A variant of this kind is particularly useful when a washer must be laid directly upon wooden planking, for example, as arises in the case of domed structures among others. This allows a washer with a large opening to be secured with a normal countersunk-head fastener. At the same time, such designs may be used primarily for fasteners intended as anchors in thin sheet-metal and with large outside thread diameters, e.g. for concrete. A fastener of this kind may still be introduced by the washer. In this connection it would also be conceivable to fit a tubular extension 6, used in such a case, with an axial slot, so that the said extension could be fitted laterally, even with a correspondingly large thread-diameter.

Figure 20:
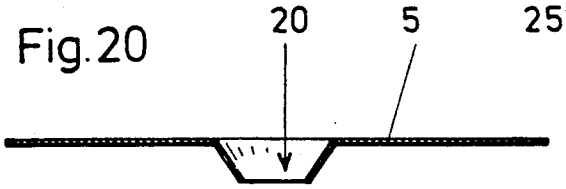
FIG. 20 is a cross-sectional view of another embodiment of a washer.

FIG. 20 shows a design of washer 5 such as has hitherto been used and which may also be used in a similar manner with the design of an attachment element according to the invention. A washer of this kind, with an inwardly drawn depression 20, must, of course, be used only when a correspondingly flexible material, i.e. an insulating material, is to be secured.

Figure 13:
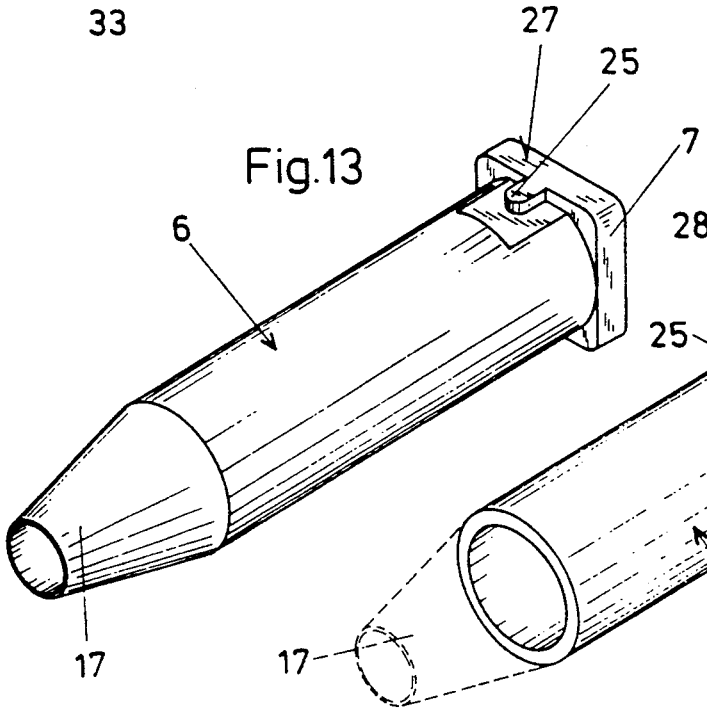
FIG. 13 is a perspective view of a first embodiment of a tubular extension with a specially designed lug at one end.

In the design according to FIG. 13, a shoulder 7 is arranged at the end of tubular extension 6, the said shoulder being approximately square in plan view. An appropriate design of the depression in washer 5 could prevent the said extension from rotating. In addition to this, this square design of shoulder 7 provides optimal guidance when feeding extension 6 into a storage-channel since lugs 25, projecting in the axial direction, can slide accurately along the guide-paths and lateral surfaces 27 of shoulder 7 prevents lateral pivoting.

Figure 14:
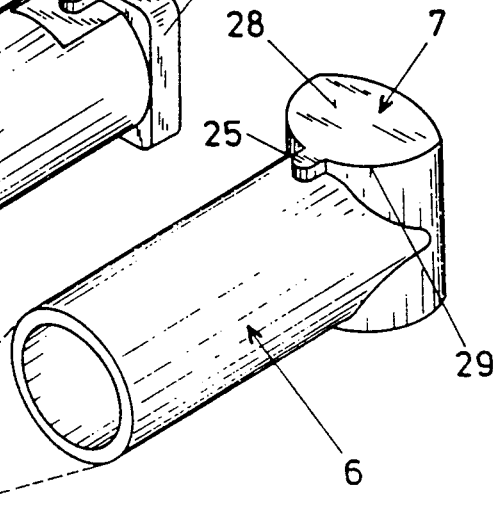
FIG. 14 is a perspective view of a second embodiment of a tubular extension with a specially designed lug at one end.

In the design according to FIG. 14, shoulder 7 arranged at the end of extension 6 is also defined laterally by two flat surfaces 28 which again act as guides during feeding into a storage-channel. In addition to this, lower boundary 29 of shoulder 7 is rounded off so that it is a simple matter for tubular extension 6 to pivot about an axis lying in the plane of the washer. This provides an additional equalizing possibility between washer 5 and extension 6, especially in the event of a lateral load being applied to the said washer.

Figure 15:
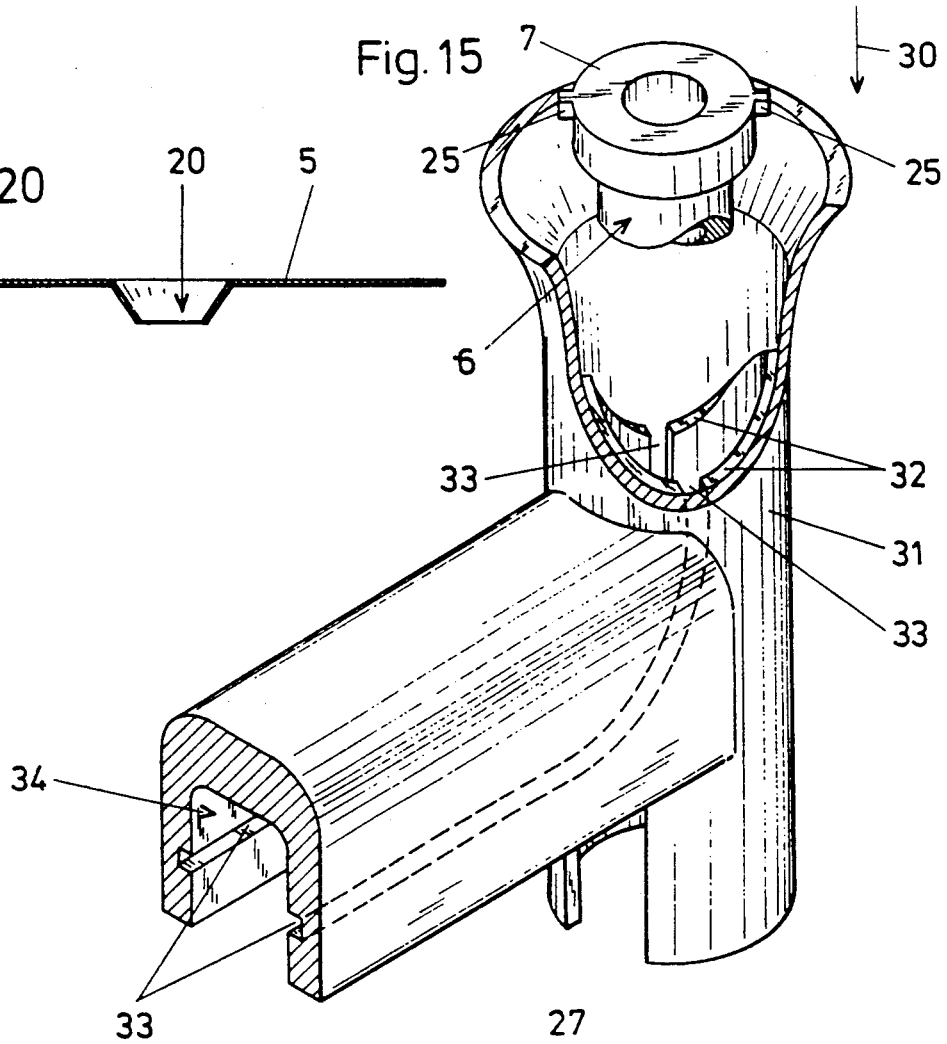
FIG. 15 is a perspective view of a tubular extension in the form of a feed-device of this kind in a setting tool.

FIG. 15 is a diagrammatical representation of a single guide for tubular extensions 6 whereby the said extensions may also be equipped at the same time with corresponding screws. These extensions are inserted from above, in the direction of arrow 30, into a tubular section 31. During this insertion, the position of laterally projecting lugs 25 is immaterial. Provided in the interior of tubular section 31 are guide-surfaces 32 which fall away to two sides, upon which projecting lugs 25 impinge. This provides immediate orientation of tubular extension 6 and the said projecting lugs therefore engage in guide-slots 33 adjoining guide-surfaces 32 laterally. The said slots are then guided in a channel 34 to the point of use, i.e. below the screwing device. It is therefore possible, depending upon the length of feed-channel 34, to store several tubular extensions 6 one behind the other and each of these fall into the screwing channel during subsequent screwing operations. In order to ensure an orderly feed, the guide-slot 33 or the feed-channel 34 itself is inclined at an acute angle to the screwing device.

Figure 16:
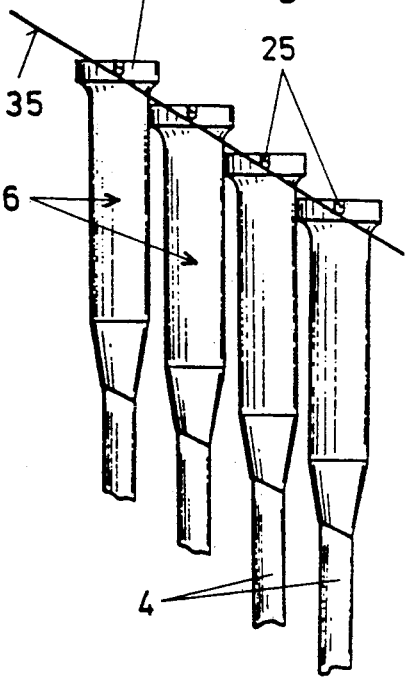
FIG. 16 illustrates a first embodiment of a storable feed-arrangement for tubular extensions.
Figure 18:
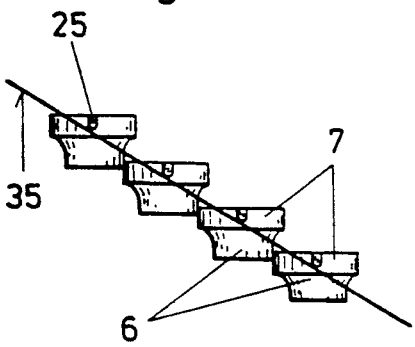
FIG. 18 illustrates a second embodiment of a storable feed-arrangement for tubular extensions.

FIG. 16 shows how individual tubular extensions 6 are prestored consecutively upon an inclined guide-path 35 for feeding. Projecting lugs 25 are supported by guide-paths 35 on both sides, lateral spacing being assured by the positioning of tubular extensions 4 themselves. The same possibility is, of course, also available with relatively short tubular extensions 6, as shown in FIG. 18. Optimal vertical alignment of extensions 6 naturally occurs if the screws are already inserted into the extensions and the necessary weight produces vertical alignment.

Figure 4:
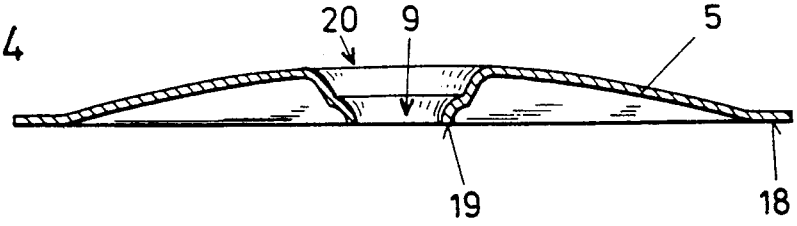
FIG. 4 is a longitudinal cross-sectional view of a washer according to FIG. 2, along section line IV—IV of FIG. 5.
Figure 5:
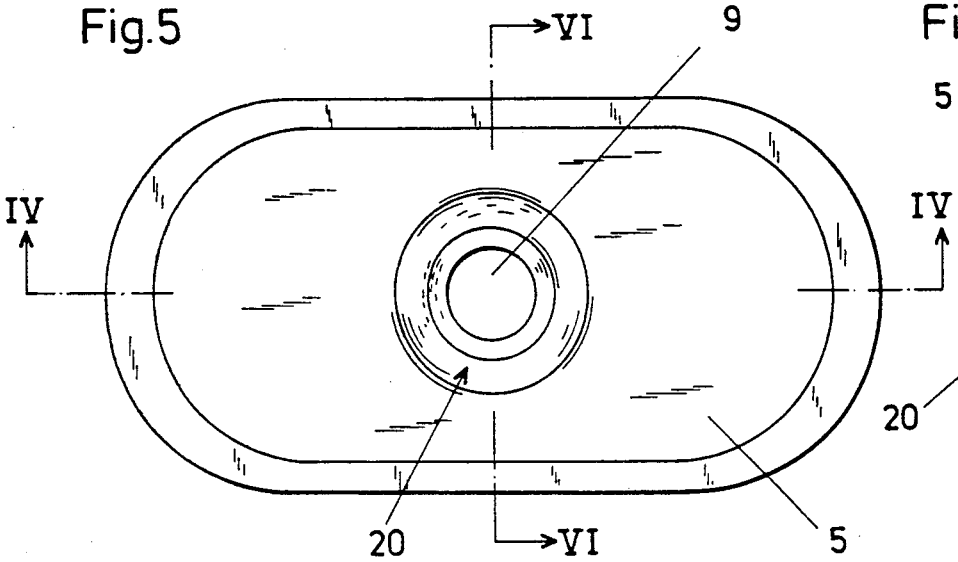
FIG. 5 is a top planar view onto a washer according to FIG. 2.
Figure 6:
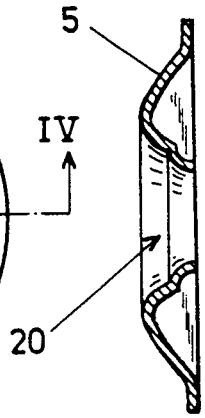
FIG. 6 is a transverse cross-sectional view of a washer according to FIG 2, along section line VI—VI of FIG. 5.
Figure 7:
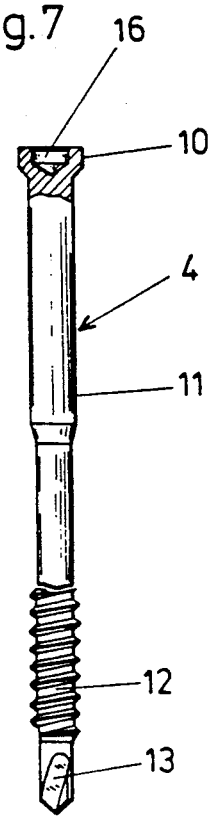
FIG. 7 is a perspective view of an inserted screw according to FIG. 2.
Figure 17:
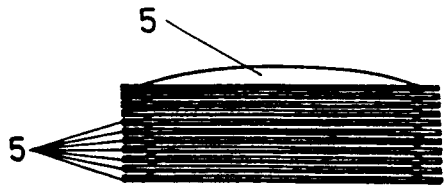
FIG. 17 illustrates a stack of stored washers.

FIG. 17 shows that the washers stack very well even with the design according to FIGS. 4 and 6.

Figure 19:
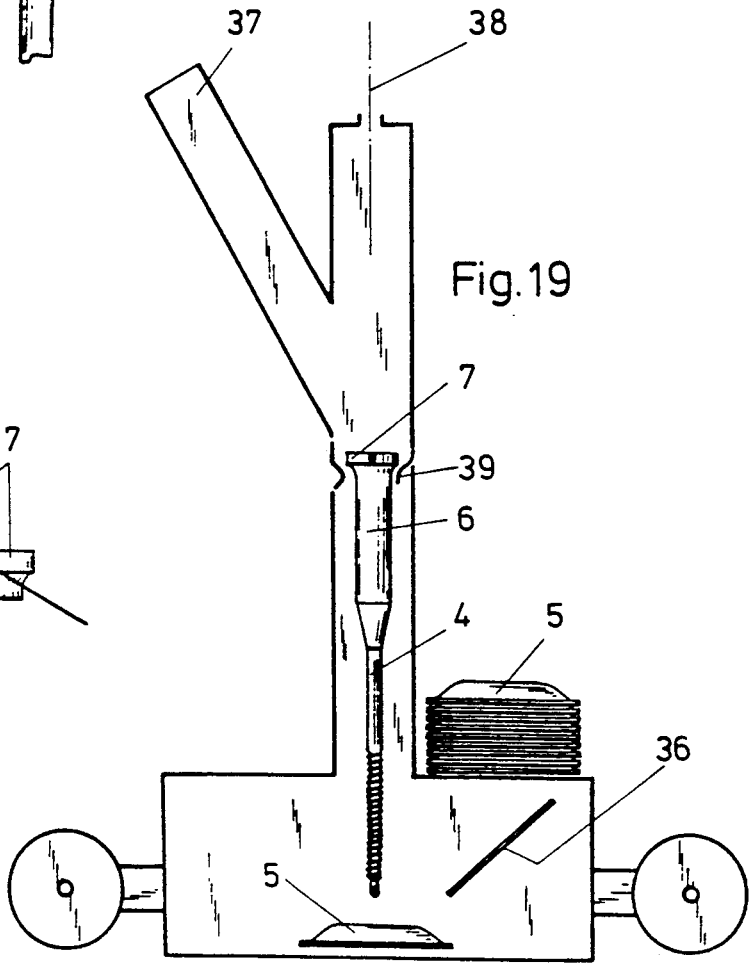
FIG. 19 is a diagrammatical view of a setting tool have a single-feed facility for tubular extensions equipped with screws and for a stack of washers held in readiness.

FIG. 19 is a diagrammatical view of a setting tool in which a washer 5 can be fed, along an inclined chute 36, after each setting operation. Tubular extensions 6, already fitted with screws 4, can be fed individually through a channel 37, so that they reach the position of screwing axis 38. Corresponding spring-loaded holders 39, engaging below shoulder 7 of tubular extension 6, hold the unit, consisting of screw 4 and extension 6, in this position until the screwing device engages the drive in the head of the screw. Prestored feeding is possible even with a design of this kind, as long as a corresponding feeding device is provided at the inlet-end of channel 37.

FIGS. 21 to 23 illustrate another design of extension 6. In this case the said extension consists of a plurality of coaxial sleeves 39 to 42 inserted coaxially into each other and secured in relation to each other. The design can be simplified by making the said extension out of a multi-layer wound sheet-metal blank. The design according to FIGS. 21 to 23 may thus be made of single sleeves 39 to 42 or of several layers 39 to 42 of a sheet-metal blank appropriately wound. Outermost sleeve 39, or outer layer 39, exhibits at one end two diametrically opposed projections 43, the action of which corresponds in practice to that of shoulder 7 of the design according to FIG. 2. In a design of this kind, it is also possible for outermost sleeve 30, or the corresponding outer layer in the case of a sheet-metal blank, to comprise, in the guidance-area for head 20 of the screw, an inwardly pressed tab, lug or the like 44. This prevents washer 5, with tubular extension 6, from being forced down in relation to screw 4. A projecting lug 25 is formed in a window 45 stamped out on opposite sides. This lug may again be used for support and guidance on a corresponding guide-path 35. Lateral boundaries 46 of this stamped-out window 45 also prevent tubular extension 6 from rotating in the guide-section.

FIG. 23 shows that it is possible to store screws together with fitted extensions 6. Known magazine-strips 47 may be used for this purpose.

Figure 24:
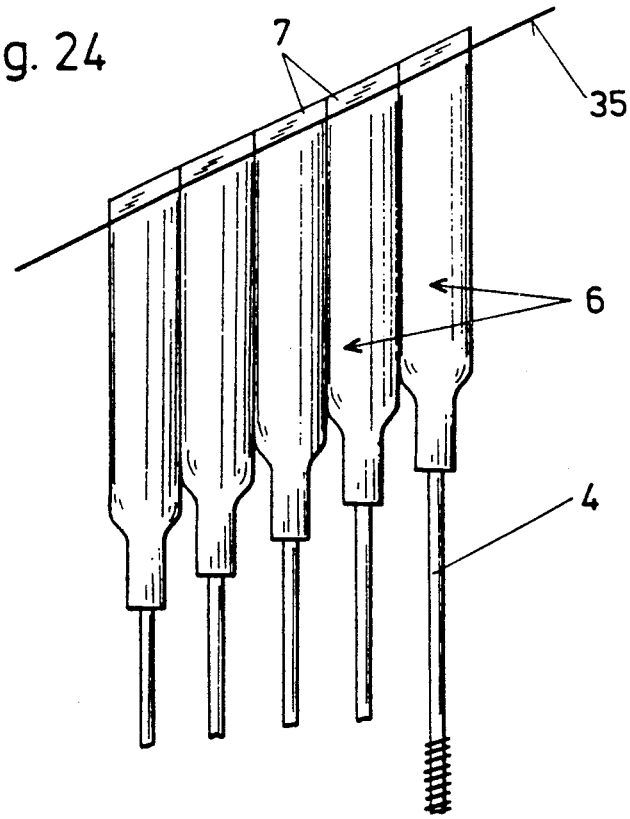
FIG. 24 illustrates a special design of shoulder located at one end of the tubular extension.
Figure 25:
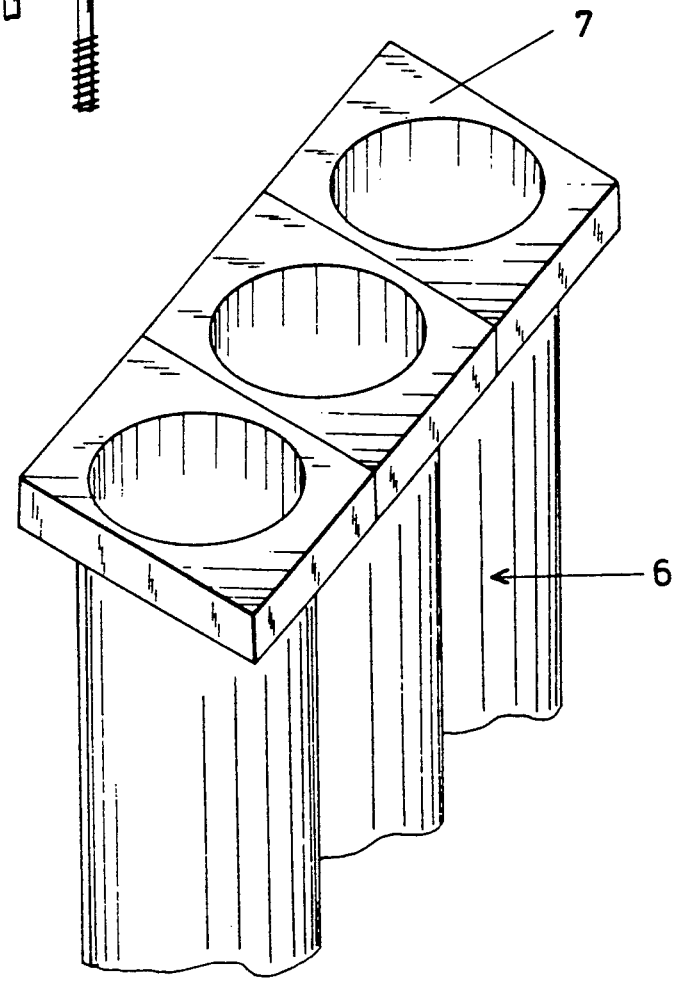
FIG. 25 is a perspective view onto the special design of shoulder of FIG. 24.

FIGS. 24 and 24 show a special design of tubular extension 6. In this case shoulder 7 is aligned at one end of extension 6 at an acute angle to the longitudinal axis of the said extension. This angle corresponds to the angle of inclination or guide-path 35 which is used for the prestored feeding of extensions 6 together with screws 4. With an arrangement of this kind, a special design of washer 5 is needed, depending upon the type of attachment.

Figure 26:
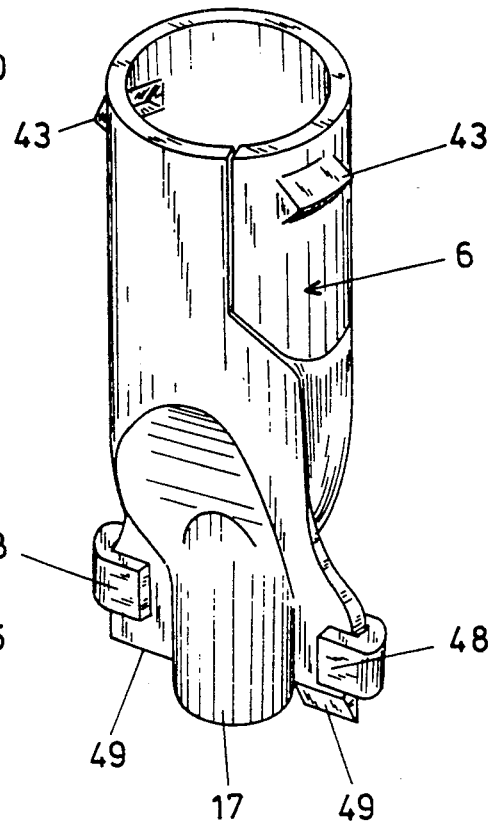
FIG. 26 is a perspective view of a tubular extension with projections in place of a shoulder.

In the design according to FIG. 26, tubular extension 6 is also made from a sheet-metal blank which is formed, after the stamping operation, into a tubular element. A compact tubular extension 6 is obtained by means of bent tabs 48. In a design of this kind, it is essential for cutting edges 49 to be provided laterally at the free end 17 of extension 6 and projecting radially. Thus when tubular extension 6 is co-rotated, an opening is cut into the insulating material, i.e. a corresponding opening is drilled out. Here again diametrically opposed projections 43 are provided in place of a shoulder 7.

Figure 27:
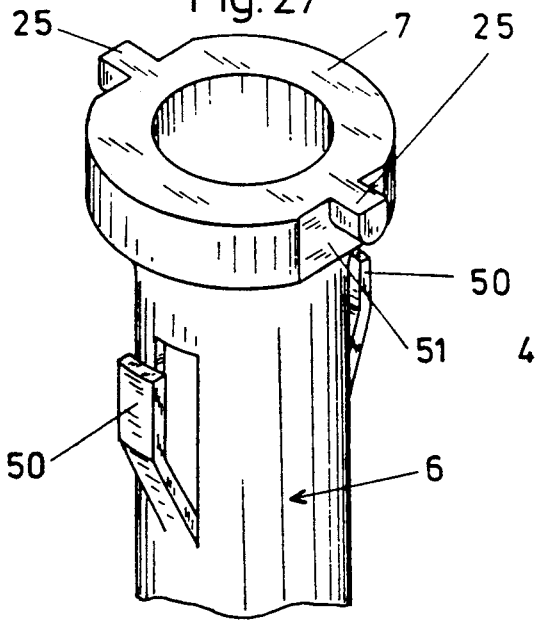
FIG. 27 is a perspective view of an embodiment of a tubular extension with clips projecting in the shank area.
Figure 28:
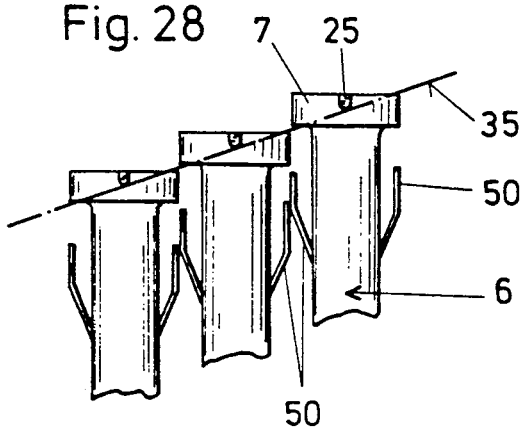
FIG. 28 illustrates a feed-device of extensions of such a kind in a storage duct.

In the design according to FIGS. 27 and 28, extension 6 is provided with clips 50, resembling wall-dowels which project in a direction opposite to the direction of insertion but can be pressed inwardly resiliently. These clips allow tubular extension 6 to be pushed through the opening in washer 5, after which it is held by the said clips. These expand into the soft insulating material and prevent the extension from rotating. In such a case, conical end 17 of extension 6 is also provided with an arrangement which definitely provides a clamping or braking effect. This can also restrict the tendency of the screw to loosen. In this design, clips 50 projecting from the extension are arranged at 90° in relation to lugs 25 disposed on shoulder 7. It may be gathered from FIG. 28 that lugs 25 may slide upon a guide-path 25 and that, in such a case, projecting clips 50 of consecutive extensions 6 ensure orderly spacing between tubular extensions 6.

Figure 29:
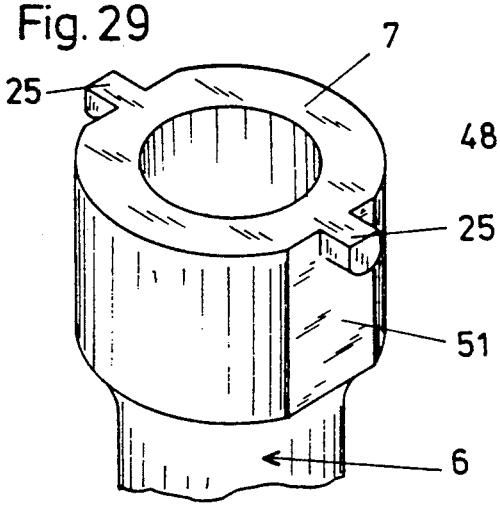
FIG. 29 is a perspective view of a first embodiment of a tubular extensions in the vicinity of the shoulder arranged at one end.
Figure 30:
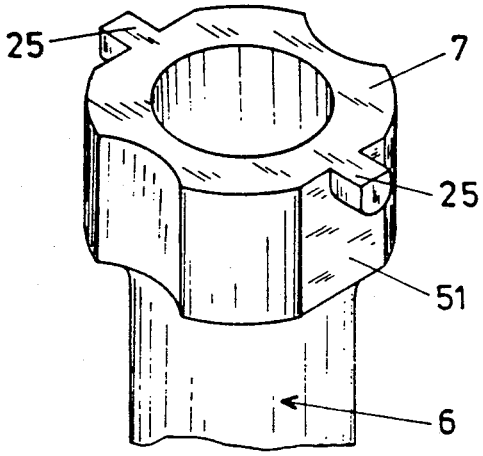
FIG. 30 is a perspective view of a second embodiment of a tubular extensions in the vicinity of the shoulder arranged at one end.

In the design according to FIG. 27, and in that according to FIGS. 29 and 30, shoulder 7 comprises flats 51 in the vicinity of projecting lugs 25, the said flats running at right angles to the said lugs and providing, in addition to other possibilities, orderly lateral guidance in a magazine channel. This prevents extensions 6 from rotating during feeding, thus eliminating feeding problems. FIG. 30, in particular, shows that shoulder 7 may have different cross-sectional shapes which have positive effects, depending of the application.

The measures according to the invention also provide additional possibilities for storage. For example, several tubular extensions 6 may be arranged in parallel with each other and may be connected together by webs which can be separated or torn apart. For example, it would be conceivable to connect a joint between adjacent extensions 6 by projecting clips 50 according to FIG. 27. It would also be possible to provide prestorage together with the screws, so that the setting operation would be substantially faster.

Figure 31:
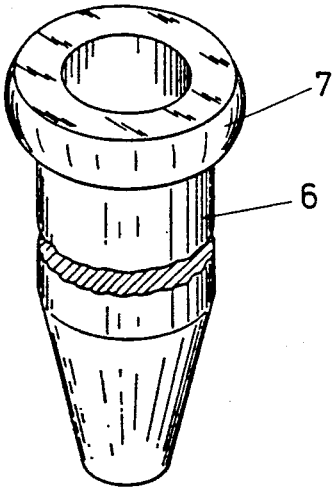
FIG. 31 is a perspective view of a tubular extension with a shoulder formed as a bead.

Also possible within the scope of the invention is the design according to FIG. 31 in which shoulder 7 is formed as a bead at one end of extension 6. Among other things, this would also make it possible for shoulder 7 to lock into a matching opening in washer 5. However, a design of this kind also ensures simple guidance for a magazine-feed, since no large lateral surfaces bear against corresponding guide-walls.

Figure 32:
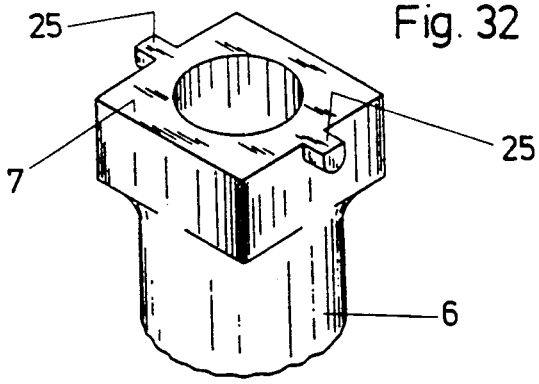
FIG. 32 is a perspective view of a tubular extension with a shoulder having a square contour and lugs.
Figure 33:
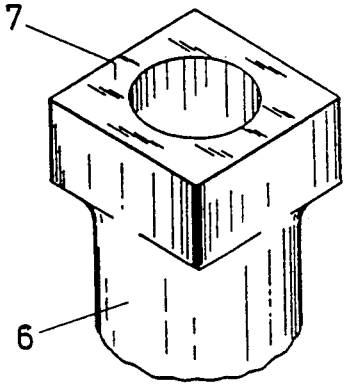
FIG. 33 is a perspective view of a tubular extension with a shoulder having a square contour.

In FIGS. 32 to 36, shoulder 7 has a square external contour at the upper end of extension 6. A configuration of this kind makes it easily possible to stack the extensions, even if they are prestored with screws since the flat sides of the shoulders may bear one against the other. If, as shown in FIG. 32, laterally projecting lugs 25 are provided, stacking is possible in one direction only. This design of the extension as a cylindrical tube with an adjoining square shoulder 7, makes it very easy to form a stack, whether the screws are already inserted before the point of use or even if they project on both sides for handling advantages. This subsequently makes storage possible with no additional aids.

Figure 35:
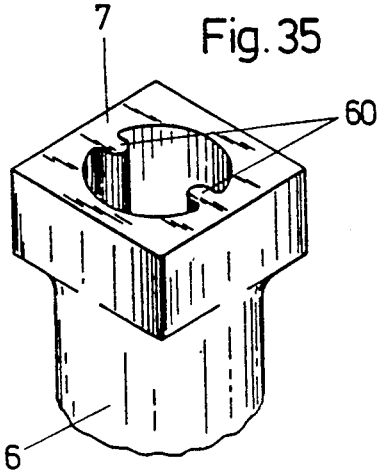
FIG. 35 is a perspective view of a tubular extension with ribs in the extension wall opening.

The design according to FIG. 35 shows another way of obtaining a frictional connection between the screw, or the head of the screw, and tubular extension 6. In this case, one or more ribs 60, running in the axial direction, are provided in the wall of the opening within the said extension. It is also possible for the free ends of these ribs to be cylindrical. By corresponding angular displacement they may bear, at sundry peripheral locations, upon the shank or head of the screw, thus providing a centering effect and a frictional connection.

Figure 36:
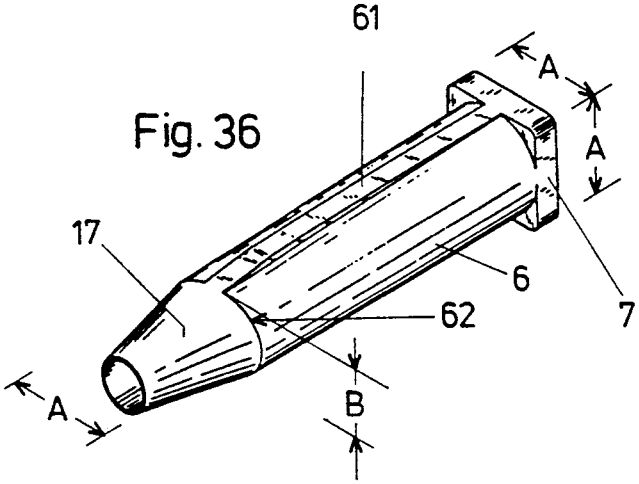
FIG. 36 is a perspective view of an extension with a conical tubular part.
Figure 34:
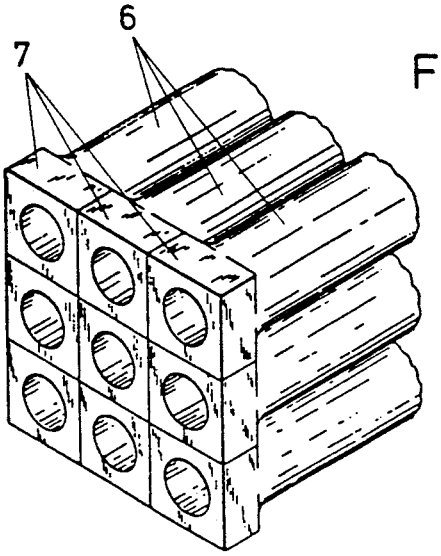
FIG. 34 illustrates a method for stacking tubular extensions.

In the design according to FIG. 36, the tubular part of extension 6 is conical. In other words, immediately adjoining shoulder 7 the cross-section is circular, whereas section 62, facing the free end is elliptical in cross-section. This may also be gathered from dimensions A and B in the drawing. Free end 17 of extension 6 then merges again into a final circular cross-section. In spite of this, in order to make orderly stacking possible, as a result of approximately square shoulder 7, a web 61 is also provided, at least on two opposite sides so that, over a relatively long stretch, in relation to the length of extension 6, the same dimension A is assured for the extensions to be stacked one above the other.

The approximately square external contour of shoulder 7 also prevents the fastener from becoming loose, for example when the said shoulder engages in a rectangular opening in washer 5.

If the attachment element according to the invention is used in masonry or concrete, it is usually necessary to predrill a hole. Because of the optimal magazinability of the attachment element according to the invention, a wall-dowel may be placed upon the free end of the screw and may thus also be prestored in the magazine.

The prestored, consecutive, tubular extensions are preferably staggered vertically in relation to each other, so that planes conceived by the free ends of the extensions run at an acute angle to the longitudinal axes thereof. This provides an orderly feed and settling into correspondingly inclined guide-paths.

It has already been indicated that, in the case of relatively short tubular extensions 6 (see FIG. 12, for example), a longitudinal slot could be provided. In the case of longer tubular extensions, however, it is also conceivable to provide a continuous axial slot which naturally makes the extension completely independent of possible very large thread-diameters in screw 4.

An abundance of requirements can be met optimally by the attachment element according to the invention. For instance, economical setting is possible, corrosion-resistance of the attachment is assured, the element is prevented from becoming loose, the roofing material is secured and insulating materials may be secured to the roof with long-term reliability. This requires a series of measures which can also be covered by the designs according to the invention.

Making the extensions out of steel sheet, preferably stainless steel sheet, certainly requires some testing, but this solution certainly looks promising. A design extruded from an aluminum alloy is also conceivable. The tubular extension could also be designed as a zinc die-casting. Regardless of the material used, the said tubular extension should form a telescoping element, should have means for prestoring which prevent overcrowding and ensure that the fastener does not become jammed in the sloping feed. Furthermore, a frictional connection can be produced between the screw fastener and the washer, thus positively preventing the attachment element from becoming loose.

Another way of preventing loosening is to provide the outer periphery of the extension with projecting ribs, ridges, grooves or tooth-like projections. The latter may be of saw-tooth design. Thus not only is the screw connected frictionally with the extension, but a frictional connection is also obtained between the extension and the insulating and roofing material.

Magazine prestorage may also be carried out directly with metallic fasteners, but it would then no longer be possible to use the telescoping effect which is an advantage in the case of very thick insulating materials. At present, therefore, individual production of tubular extensions in any desired length is the best way of producing and also packaging them. In addition to this, continuous production, in the form of plastic injection-molding is also very satisfactory. This makes it possible to feed a bar-magazine, possible already filled with screws, to a setting device. The bar need then only be threaded into the setting device, after which 20 or even 40 attachment elements may be preloaded at once.

I claim:

1. An attachment element having a large washer and a tubular extension formed on the washer for the passage and guidance of a screw, wherein the washer (5) and the tubular extension (6) are formed as parts separate from each other, and wherein the said tubular extension (6) exhibits, at its end facing the washer, a shoulder (7), and wherein a section (8), adjoining this end area, of the tubular extension (6), corresponds approximately to the passage cross-section of an opening (9) in the washer (5), wherein the free inside diameter of the extension (6) corresponds, along its greatest length, approximately to the outside diameter of a head (10) of the screw (4) to be inserted, and wherein the free end (17) of the extension is narrowed to the shank or outside diameter of the thread to the screw to be inserted to produce a friction-contact mounting between the extension (6) and the inserted screw such that the said tubular extensions with the inserted screws can be prestored in a magazine.

2. The attachment element according to claim 1, wherein the extension (6) consists of a plurality of sleeves inserted coaxially into each other and secured mutually.

3. The attachment element according to claim 2, wherein the outermost sleeve (39) of the extension (6) consisting of several sleeves, comprises at one end, at least on two diametrically opposite sides, lug-shaped projections (43).

4. The attachment element according to claim 2, wherein the outermost sleeve of the extension (6) comprises, in the guidance-area for a screw-head (10), at least one tab projection (44) pressed inwardly at an acute angle.

5. The attachment element according to claim 1, wherein the extension (6) is in the form of a part wound out of a multilayer sheet-metal blank.

6. The attachment element according to claim 5, wherein the outermost layer (39) of the extension consisting of a multilayer winding, comprises at one end, at least on two diametrically opposite sides, lug-shaped projections (43).

7. The attachment element according to claim 5, wherein the outermost layer (39) of the extension (6) comprises, in the guidance-area for a screw-head (10), at least one tab projection (44) pressed inwardly at an acute angle.

8. An attachment element having a large washer and a tubular extension formed on the washer for the passage and guidance of a screw, wherein the washer (5) and the tubular extension (6) are formed as separate parts, and wherein the said tubular extension (6) exhibits, at its end facing the washer, a shoulder (7), and wherein a section (8), adjoining this end area, of the tubular extension (6), corresponds approximately to the passage cross-section of an opening (9) in the washer (5), wherein the free inside diameter of the extension (6) corresponds, along its greatest length, approximately to the outside diameter of a head (10) of the screw (4) to be inserted, and wherein the free end (17) of the extension is narrowed to the shank or outside diameter of the thread to the screw to be inserted to produce a friction-contact mounting between the extension (6) and the inserted screw such that the said tubular extensions with the inserted screws can be prestored in a magazine; wherein the tubular extension (6) and the screw (4), consisting of at least two sections of different materials and of different hardness, are assembled by welding.

9. The attachment element according to claim 8, wherein the washer (5) is made of metal and the tubular extension (6) is made of plastic.

10. The attachment element according to claim 8, wherein the washer (5) and the tubular extension (6) are made of plastic.

11. The attachment element according to claim 8, wherein the washer (5) and the tubular extension (6) and the screw (4) are made of a stainless steel.

12. The attachment element according to claim 8, wherein the free end of the extension (6) is cut off at an acute angle to the longitudinal axis of the extension (6) in order to form a drill-bit (24).

13. The attachment element according to claim 8, wherein the washer (5) having a peripheral edge (18), is arched and comprises a central, conical depression (20), having a peripheral edge (19), and wherein the peripheral edge (18) of the washer (5) and the peripheral edge (19) of the central depression (20) are disposed approximately in one plane.

14. The attachment element according to claim 8, wherein the shoulder (7), formed on the extension (6), has a cross-sectional shape which about matches the cross-sectional shape of the central depression (20) in the washer (5).

15. The attachment element according to claim 8, wherein the outside diameter of the threaded section (12) of the screw (4) corresponds to the inside diameter of the free end (17) of the extension (6), and wherein a sleeve (22), corresponding to the outside thread diameter, is placed upon a smaller-diameter shank-section (11), between the threaded section (12) and the head (10) of the screw.

16. The attachment element according to claim 15, wherein the sleeve (22), adapted to be placed upon the thread-free shaft-section (11), comprises a continuous longitudinal slot (23).

17. The attachment element according to claim 8, wherein the end of the extension (6) associated with the washer (5) comprises pairs of opposing, projecting lugs (25).

18. The attachment element according to claim 17, wherein the lugs (25) project radially from the shoulder (7) formed at the free end of the extension (6).

19. The attachment element according to claim 17, wherein the lugs, projecting axially from the shoulder (7), are directed towards the other free end (17) of the extension (6).

20. The attachment element according to claim 17, wherein the lugs 25 exhibit surfaces (26) and wherein these surfaces (26) of the lugs (25), directed toward the one free end of the extension (6), are rounded off.

21. The attachment element according to claim 17, wherein , in the vicinity of the projecting lugs (25), the shoulder (7) comprises flats (51) running at right angles to the said projecting lugs.

22. The attachment element according to claim 8, wherein the shoulder (7), at one end of the extension (6), is at an acute angle to the longitudinal axis of the said extension.

23. The attachment element according to claim 8, wherein cutting edges (49), projecting laterally at the side of the sleeve-shaped element, are formed at the free end of the extension (6) remote from the shoulder (7) and the projections (43).

24. The attachment element according to claim 8, wherein the extension (6) comprises clips (50) which are adapted to be pressed inwardly resiliently, which resemble a wall-dowel, and which project in a direction opposite to that of insertion.

25. The attachment element according to claim 24, wherein the clips (50), projecting from the extension (6), are displaced by 90° from the lugs (25) on the shoulder (7).

26. The attachment element according to claim 8, wherein several tubular extensions (6), aligned in parallel with each other, are connected together by webs which can be separated or torn apart.

27. The attachment element according to claim 8, wherein wall-dowels are placed upon the free ends of the screws (4) inserted into the prestored extensions (6).

28. The attachment element according to claim 27, wherein the tubular extensions (6), consecutively prestored in a magazine, are staggered in height in relation to each other, such that planes, conceived by the free ends of the said extensions, run at an acute angle to the longitudinal axes thereof.

29. The attachment element according to claim 8, wherein the tubular extension (6) comprises a continuous, lengthwise, axial slot.

30. The attachment element according to claim 8, wherein at least one rib (63), running in an axial direction, is provided in the wall of the opening within the extension (6).

31. The attachment element according to claim 8, wherein the shoulder (7), at the end of the extension (6), exhibits a square external contour.

32. The attachment element according to claim 8, wherein the tubular extension (6) exhibits projection (43) at its end facing the washer (5).

33. The attachment element according to claim 8, wherein the tubular extension (6) exhibits lugs (25) at its end facing the washer (5).

34. The attachment element according to claim 8, wherein the tubular extension (6) and the screw (4), consisting of at least two sections of different materials and of different hardness, are assembled by gluing.

35. The attachment element according to claim 8, wherein the washer (5), having a peripheral edge (18), is arched and comprises a central, multi-stepped depression (20), having a peripheral edge (19), and wherein the peripheral edge (18) of the washer (5) and the peripheral edge (19) of the central depression (20) are disposed approximately in one plane.

36. An attachment element having a large-surface washer and a tubular extension formed at the washer for passage and telescopically shiftable guidance of a screw having a head, wherein the free inner diameter of the extension over its largest length corresponds about to the outer diameter of the head of the screw to be inserted, wherein the washer (5) and the tubular extension (6) are formed as two separate parts, and wherein the said tubular extension exhibits at its end facing the washer a shoulder (7), and wherein a section (8), adjoining said end area, of the tubular extension, corresponds approximately to the passage cross-section of an opening (9) in the washer (5), and wherein the free end (17) of the extension is tapered to the shank or outside diameter of the thread of the screw, said screw to be inserted to produce a friction-contact mounting between the extension and the inserted screw (4) such that the tubular extensions (6) with inserted screws (4) can be prestored in a magazine.

37. The attachment element according to claim 36, wherein the tubular extension (6) exhibits projections (43) at its end facing the washer (5).

38. The attachment element according to claim 36, wherein the tubular extension (6) exhibits lugs (25) at its end facing the washer (5).

* * * * *